US005366090A

United States Patent [19]

Schutz

[11] Patent Number: 5,366,090

[45] Date of Patent: Nov. 22, 1994

[54] PALLET CONTAINER

[76] Inventor: Udo Schutz, Ruckersteg 4, D-5418 Selters, Germany

[21] Appl. No.: 217,757

[22] Filed: Mar. 25, 1994

Related U.S. Application Data

[63] Continuation of Ser. No. 977,201, Nov. 16, 1992, abandoned.

[30] Foreign Application Priority Data

Nov. 14, 1991 [DE] Germany ..... 4137494

[51] Int. Cl.[5] ..... B65D 19/06; B65D 19/42

[52] U.S. Cl. ..... 206/599; 206/600; 220/1.5; 220/470

[58] Field of Search ..... 206/386, 599, 600; 220/1.5, 470; 215/1 C; 108/11, 14; 280/43.12, 43.24

[56] References Cited

U.S. PATENT DOCUMENTS

| | | | |
|---|---|---|---|
| 2,572,348 | 10/1951 | Johnson | 280/43.24 |
| 4,108,455 | 8/1978 | James | 280/43.24 X |
| 4,676,373 | 6/1987 | Schneider | 206/600 X |
| 4,817,824 | 4/1989 | La Fleur et al. | 206/600 X |
| 5,014,872 | 5/1991 | Robbins, III | 220/470 X |

FOREIGN PATENT DOCUMENTS

| | | |
|---|---|---|
| 2442322 | 3/1976 | Germany . |
| 2656639 | 6/1977 | Germany . |
| 86277081 | 1/1987 | Germany . |
| 89060598 | 11/1989 | Germany . |

OTHER PUBLICATIONS

"Flexible Behalter fur Schuttgut senken die Transportkosten", *MM Maschinenmarkt,* vol. 83, No. 31, p. 619.

*Primary Examiner*—Jacob K. Ackun, Jr.
*Attorney, Agent, or Firm*—Young & Thompson

[57] ABSTRACT

The pallet container (1) for transport and storage of liquids comprises a collapsible outer jacket (2) of a metal latticework, detachably mounted on a pallet (12), and a foldable supporting insert (5) for the thin-walled plastic inner container (6), this insert being in contact with the outer jacket (2). The plastic inner container (6) consists of a rigid, dimensionally stable bottom section and a flexible top section that can be inverted into the bottom section for stacking and shipping purposes. The pallet container (1) can be readily and quickly disassembled for empty shipping purposes and can be composed into a space-saving transport unit. Without the plastic inner container (6), the pallet container (1) can be utilized for the shipping and storage of piece goods and semifinished products of various kinds.

9 Claims, 4 Drawing Sheets

PALLET CONTAINER

This application is a continuation of application Ser. No. 07/977,201, filed Nov. 16, 1992, now abandoned.

FIELD OF THE INVENTION

The invention relates to pallet containers for liquids, with an inner container of a synthetic resin with respectively one sealable filling and discharge opening and with an outer jacket of metal attached to a flat pallet of metal or wood, wherein the pallet is adapted for manipulation by means of forklift, shelf-servicing device, or the like (DE 38 19 911 A1, DE 25 45 023 C2).

BACKGROUND OF THE INVENTION

The strict environmental protection laws require changeover from one-way containers, such as pallet containers and barrels for transporting and storing liquids of varying kinds, to multiple-trip containers; conversion to containers having a larger volume with the objective of reducing the residual amounts; and the development of novel multiple-trip containers which can be reconditioned with a view toward relieving the environment of harmful substances, wherein the plastic parts of such containers contaminated by the liquid material to be transported and stored can be disposed of in optimal fashion by destruction with low pollutant generation, or even no pollutant generation, for example by burning.

The use of the pallet containers of this type as reusable containers is uneconomical on account of the high return transport costs for the empty containers to the manufacturing facilities of the liquid materials and/or the filling facilities, and due to the high storage expenses since the containers occupy a large amount of space. A further drawback of the pallet containers of this type resides in disposing of the relatively large mass of plastic of the inner container when the plastic has been contaminated by the liquid material.

SUMMARY OF THE INVENTION

The invention is based on the object of further developing the pallet container of this type with a view toward lowering the empty-transport and storage costs for use as multiple-trip containers and toward an optimum disposal of the plastic inner container.

This object has been attained according to the invention by a pallet container having the features recited in the main independent claim.

The dependent claims contain suitable embodiments of the invention.

The pallet container according to this invention is distinguished by the following advantages:

By virtue of the fact that the outer jacket and the supporting insert for the inner container are collapsible, as well as by virtue of the possibility of inverting the flexible top section into the dimensionally stable bottom section of the plastic inner container, it is feasible to stack, for empty transport, the pallets and the outer jackets together with the supporting inserts one on top of the other in flat condition, and the plastic inner containers can be stacked in nested condition. Consequently, due to the considerably reduced space requirement for the collapsed pallet containers in the empty condition as compared with the pallet containers with a filled inner container, the shipping expenses for the return transport of the pallet containers to the manufacturing and filling plants for the liquid goods, and the costs for storage of the empty pallet containers, can be considerably lowered. On account of the support provided for the plastic inner container by means of a supporting insert placed into the outer jacket of grid structure, the wall thickness of the plastic inner container can be substantially reduced and thereby the mass of plastic contaminated by paints, varnishes and similar polluting liquids can be considerably decreased so that the disposal of this plastic mass by combustion poses no problems. Finally, the pallet container, for filling with liquid material, can be simply and quickly assembled and, for empty transport and for storage, can be disassembled in a simple way.

BRIEF DESCRIPTION OF THE DRAWINGS

The invention will be described in greater detail below with reference to an embodiment shown in the drawings in schematic views. In the drawings.

DETAILED DESCRIPTION OF THE INVENTION

Figure 1:
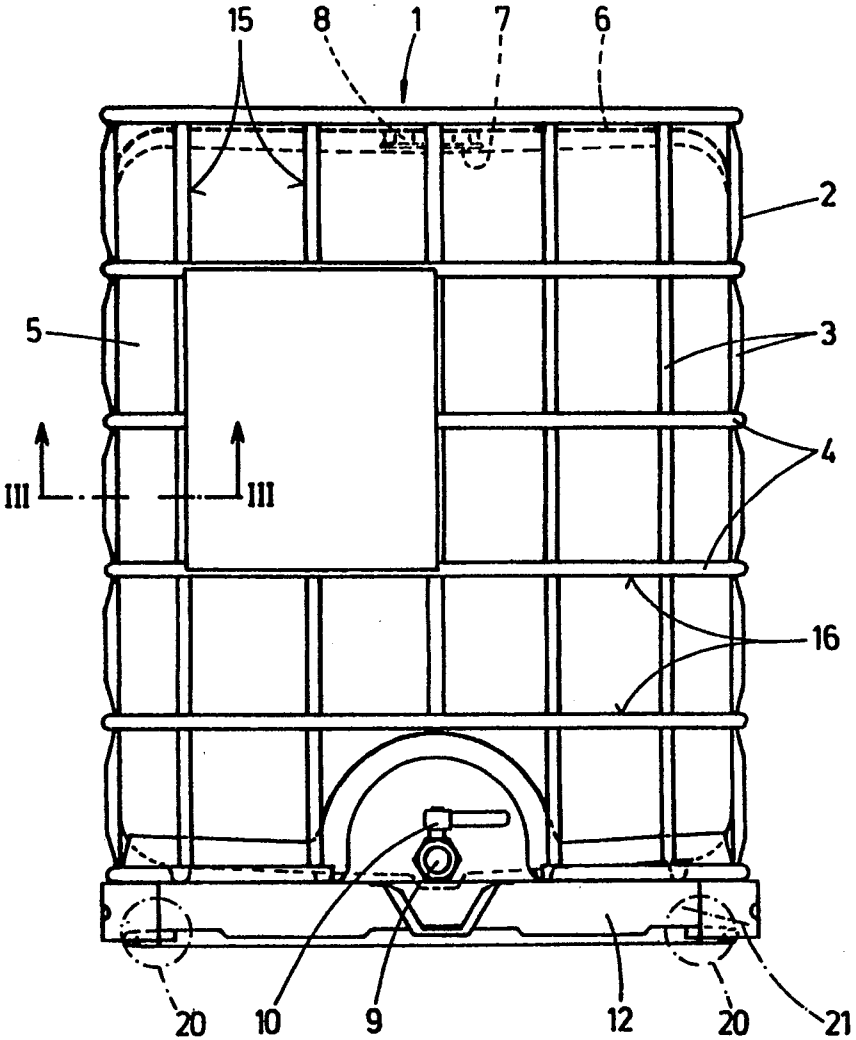
FIG. 1 is a frontal view of a pallet container with lattice jacket.
Figure 2:
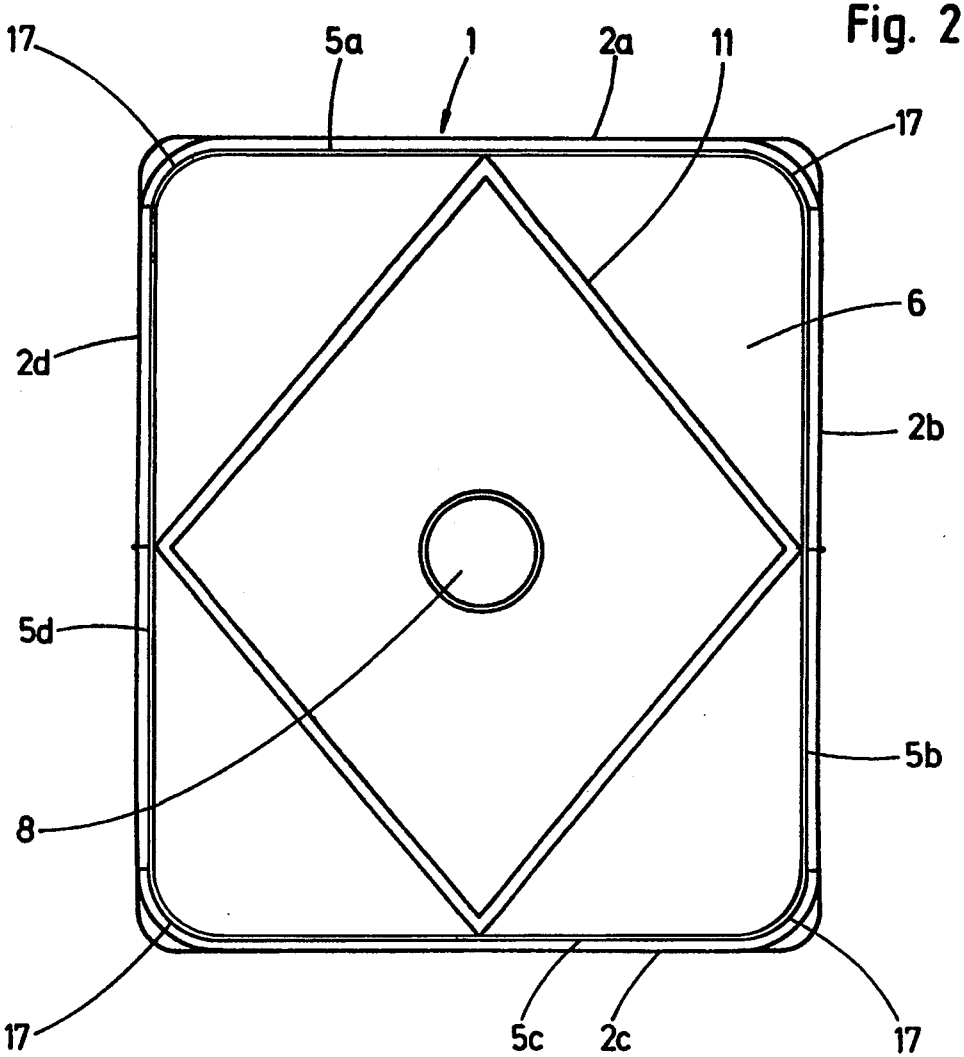
FIG. 2 is a top view of the pallet container according to FIG. 1.

The pallet container 1 according to FIGS. 1 and 2, utilized as a multiple-trip container, for the transport and storage of liquid material of various kinds comprises, as the main components, an outer jacket 2 of intersecting vertical and horizontal lattice rods 3, 4 of metal, a supporting insert 5 insertable in the outer jacket 2 for an exchangeable, thin-walled inner container 6 of a synthetic resin, preferably polyethylene, having a rectangular outline and rounded corners and being equipped with a filling fitting 7 sealable with a screw cap 8 and a drainage fitting 9 for the connection of a drainage cock 10, an upper reinforcing frame 11 exerting a lid function and made up of diagonally arranged tubular struts respectively threaded to the lattice jacket 2 in the lateral center, and a steel pallet 12 which can be manipulated by means of forklift, shelf-servicing device or the like and has length and width dimensions satisfying European standards, for carrying the inner container 6, the supporting insert 5, and the lattice jacket 2 attached to the pallet 12.

The collapsible lattice jacket 2 consists of four wall sections **2*a*–2*d* which are joined by screws or by means of hinges and are detachably mounted on the steel pallet 12**.

Figure 3:
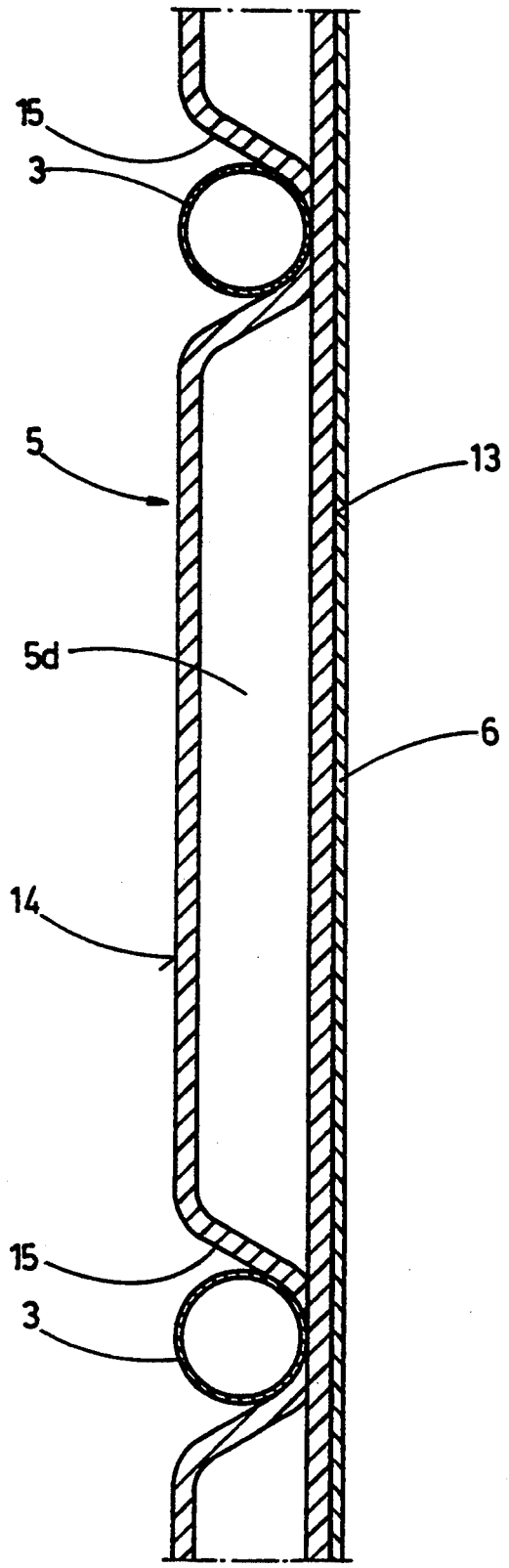
FIG. 3 shows an enlarged partial sectional view along line III—III of FIG. 1.

The foldable supporting insert 5 serving for the reinforcement of the thin-walled plastic inner container 6 and made of a plastic blow-molded part exhibits four double-panel wall sections **5*a*–5*d* with smooth inner walls 13 and outer walls 14 having vertical and horizontal troughs 15, 16 for accommodating the vertical and horizontal lattice rods 3, 4, wherein the lattice rods 3, 4 are entirely integrated into the wall sections 5*a*–5*d* to form a continuous external wall plane (FIG. 3). The wall sections 5*a*–5*d* of the supporting insert 5 are joined together by means of flexible hinge parts 17 of plastic. The hinge parts 17 of the supporting insert 5 are located at the same sites as the hinges of the lattice jacket 2 so that the wall sections 5***a*–5*d* of the supporting insert 5 can be collapsed, together with the wall sections 2*a*–2*d* of the lattice jacket 2, into a flat parcel (FIG. 5).

Figure 4:
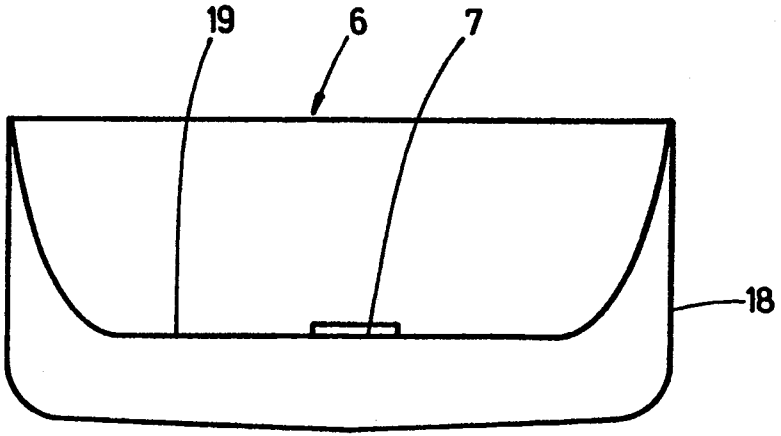
FIG. 4 is a cross section of the inner container with the top section being inverted therein.

The thin-walled plastic inner container 6 produced as a blow-molded part exhibits a rigid, dimensionally stable bottom section 18 and a flexible top section 19 that can be inverted into the bottom section 18 for stacking and shipping purposes; this top section, when a pallet container 1 is assembled, is raised up by being inflated with air or, when it is being filled, by the rising liquid (FIG. 4).

Without the plastic inner container 6, the pallet container 1 can be utilized for the shipping and storage of piece goods and semifinished products of various types.

Figure 5:
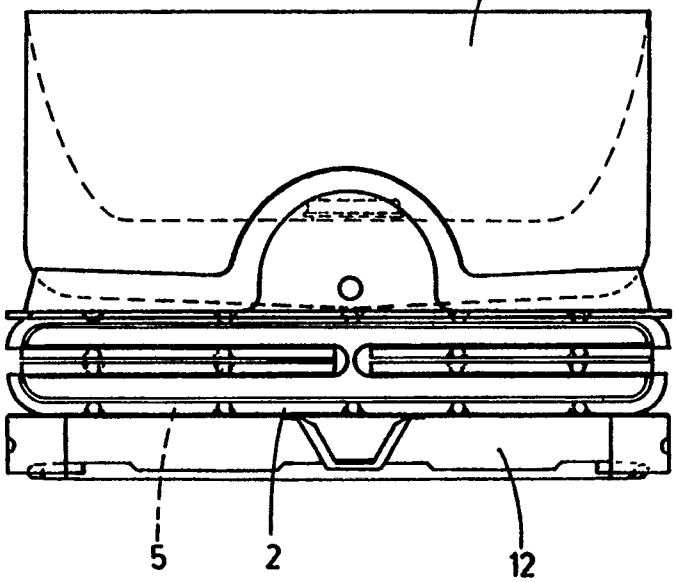
FIG. 5 shows a frontal view of a pallet container collapsed to a transport unit.

The pallet container 1, for empty transporting purposes, can be readily and quickly disassembled and composed into a space-saving shipping unit (FIG. 5).

Figure 6:
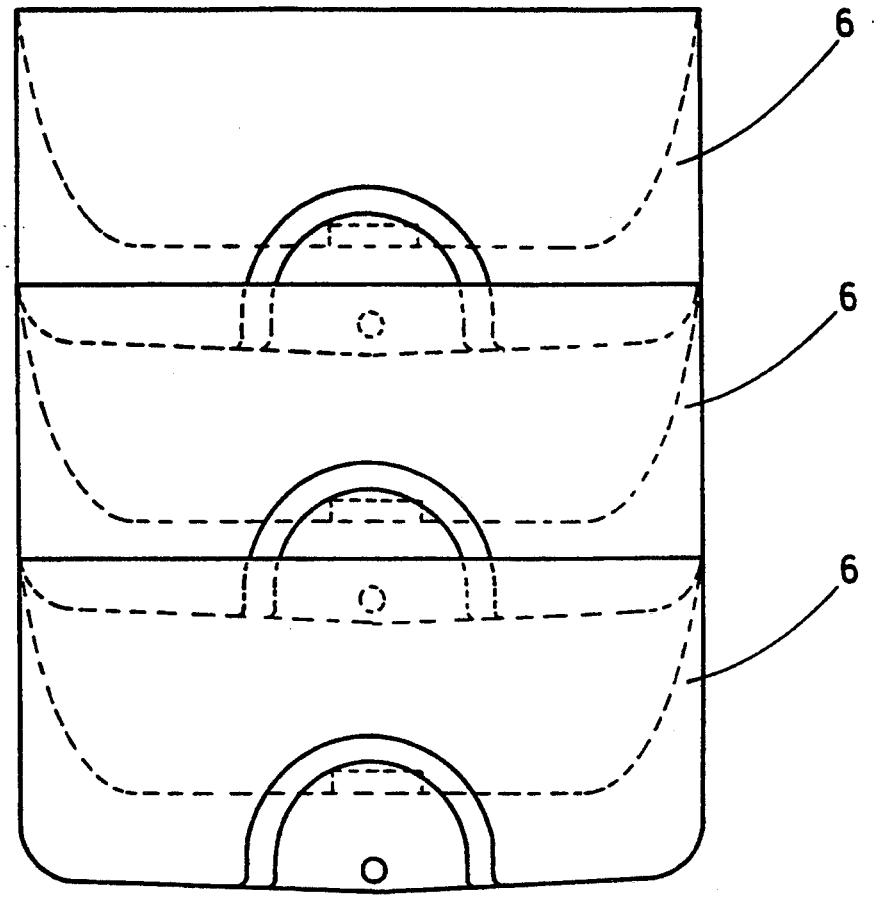
FIG. 6 is a frontal view of a stack of several inner containers.

Furthermore, there is the possibility, for shipping and storage purposes, to superimpose several pallets 12, collapsed supporting inserts 5, and lattice jackets 2 as well as inner containers 6 to form separate stacks, the inner containers 6 being stacked in nested fashion (FIG. 6).

In a modification of the described embodiment, the collapsible supporting insert 5 can consist of smooth wall sections of plastic, joined together by hinge parts of plastic or metal.

Furthermore, the supporting insert 5 can be constituted by a collapsible sheet-metal jacket of wall sections connected with one another by means of hinges.

Finally, the supporting insert 5 can consist of a rigid, container-like jacket with smooth wall sections of plastic, this jacket being fashioned to taper slightly in the bottom zone for stacking purposes.

According to the illustration in FIG. 1, there is the possibility of equipping the pallet container 1 with a mobile pallet 12 exhibiting four casters 20, at least one of the latter being provided with a locking means 21.

The casters 20 can be swung out of the rest position within the pallet 12 into the drive position underneath the pallet and, conversely, can be swung inward into the pallet from the drive position into the rest position.

A pallet container thus fashioned to be mobile is suitable, without the inner container, especially for intraplant transport of piece goods and semifinished products of all kinds, and for the storage of piece goods and semifinished products.

What is claimed is:

1. Pallet container for use as a disposable and reusable container for liquids, comprising: a flat pallet made of one of metal and wood designed for handling by one of a forklift and shelf serving device, a thin-walled inner container made of synthetic resin standing on the pallet, said inner container having respectively one sealable filling opening and discharge fitting, a collapsible outer jacket made of one of a metal latticework and of sheet metal, detachably mounted on the pallet, and a supporting insert, in contact with the outer jacket, made up of wall sections foldable into a parcel, the collapsible outer jacket being made of a metal latticework, and the wall sections of the supporting insert comprising double-panel wall sections with smooth inner walls and outer walls, and with vertical and horizontal troughs for accommodating vertical and horizontal lattice rods of said metal latticework, said lattice rods being completely integrated into the wall sections to form a continuous external wall plane, and said wall sections being joined together by hinge parts.

2. Pallet according to claim 1, wherein the supporting insert is manufactured as a blow molded plastic component.

3. Pallet container according to claim 1, wherein the supporting insert consists of smooth wall sections of plastic, joined together by hinge parts.

4. Pallet according to claim 1, wherein the supporting insert is formed by a collapsible sheet-metal jacket made up of wall sections joined by hinges.

5. Pallet container according to claim 1, wherein the supporting insert consists of a rigid jacket with smooth wall sections of plastic, made to taper slightly in a bottom zone for stacking purposes.

6. Pallet container according to claim 1, wherein the inner container is manufactured as a blow-molded, closed plastic inner container with said filling opening and said discharge fitting, and exhibits a rigid dimensionally stable bottom section and a flexible top section invertible into the bottom section for stacking and shipping purposes.

7. Pallet container according to claim 1, wherein the flat pallet is mobile and includes four casters.

8. Pallet container according to claim 7, wherein the casters can be swung out of a rest position within the pallet into a drive position underneath the pallet, and conversely, can be swung inward from the drive position into the rest position into the pallet.

9. Pallet container according to claim 7, wherein at least one of one casters is equipped with means for locking it.

* * * * *